US006785396B2

(12) United States Patent
Shirata

(10) Patent No.: US 6,785,396 B2
(45) Date of Patent: Aug. 31, 2004

(54) EARPHONE

(75) Inventor: Atsushi Shirata, Tendo (JP)

(73) Assignees: Pioneer Corporation, Tokyo-to (JP); Tohoku Pioneer Corporation, Tendo (JP)

( * ) Notice: Subject to any disclaimer, the term of this patent is extended or adjusted under 35 U.S.C. 154(b) by 0 days.

(21) Appl. No.: 10/207,131

(22) Filed: Jul. 30, 2002

(65) Prior Publication Data

US 2003/0044038 A1 Mar. 6, 2003

(30) Foreign Application Priority Data

Aug. 31, 2001 (JP) ..... 2001-264021

(51) Int. Cl.[7] ..... H04R 25/00
(52) U.S. Cl. ..... 381/381; 381/374; 381/378
(58) Field of Search ..... 381/330, 370, 381/374, 378, 379, 381, 380, 328; 181/128, 129; 379/430

(56) References Cited

U.S. PATENT DOCUMENTS 2,930,856 A * 3/1960 Toht ..... 381/381
6,418,230 B1 * 7/2002 McDonald et al. ..... 381/381

FOREIGN PATENT DOCUMENTS

CA 2070956 * 12/1992 ..... 379/430

* cited by examiner

*Primary Examiner*—Huyen Le
(74) *Attorney, Agent, or Firm*—Young & Thompson

(57) ABSTRACT

An earphone comprises a main body and an ear hanger. The main body is to be placed at an entrance of an external auditory meatus of an ear of a user. The main body includes a loudspeaker received therein. The ear hanger is connected to the main body. The ear hanger is adapted to be mounted on the ear. The ear hanger has a curved shape. The ear hanger comprises a core and a sheathing member for surrounding at least part of the core so as to provide a dual structure. The core is formed of hard material and the sheathing member is formed of elastic material.

6 Claims, 4 Drawing Sheets

EARPHONE

BACKGROUND OF THE INVENTION

1. Field of the Invention

The present invention relates an earphone, which is to be fitted directly on an ear of a user for converting an electric signal outputted from an audio system into a sound signal so as to provide acoustic output, and especially to an earphone provided with a main body including a loudspeaker received therein and an ear hanger adapted to be mounted on the ear.

2. Description of the Related Art

There have conventionally been used various kinds of compact and lightweight earphones, which were suitably applicable to portable audio systems. A user often puts on such an earphone, while being in motion. It is therefore preferable to provide such an earphone with a structure for preventing the earphone from coming off an ear of the user. In view of these circumstances, there has generally been adopted a structure in which a main body including a loudspeaker received therein was provided with an ear hanger to be turned along the outer peripheral portion of the ear so as to be mounted thereon, thus providing a fitting condition in which the loudspeaker was placed at the entrance of an external auditory meatus of the ear. When the earphone having the above-described structure is used, the user puts on it, while making a proper positional adjustment so that the loudspeaker is fitly placed at the entrance of the external auditory meatus of the ear, thus providing a stable fitting condition even when the earphone is used for a long period of time.

In the above-mentioned conventional earphone, it is necessary to form the ear hanger of material having a relatively high hardness in order to maintain a stable fitting condition in use. The ear hanger is formed for example of plastic material having a relatively high hardness.

In the earphone provided with the ear hanger formed of the plastic material having such a relatively high hardness, the resultant relatively hard ear hanger comes into direct contact with the ear of the user in a wrap-around state. Consequently, the use of such an earphone for a long period of time may give the user an unpleasant feeling in his/her ear.

It is conceivable to form the ear hanger of the earphone of elastic material such as soft rubber in view of the above-mentioned problem. This may reduce an unpleasant feeling of the user in his/her ear, even when the earphone is used for a long period of time. Formation of the ear hanger of such elastic material may make it difficult to provide a stable fitting condition in use.

Thus, the conventional earphone involves the problems that there cannot be satisfied both the requirements of providing the stable fitting condition in use and of preventing an unpleasant feeling of the user in his/her ear, even in case where the earphone is used for a long period of time.

SUMMARY OF THE INVENTION

An object of the present invention, which was made to solve the above-mentioned problems, is therefore to provide an earphone, which permits to maintain a stable fitting condition in use and prevent an unpleasant feeling of a user in his/her ear, even in case where the earphone is used for a long period of time.

In order to attain the aforementioned object, the earphone of the present invention comprises:

a main body to be placed at an entrance of an external auditory meatus of an ear of a user, said main body including a loudspeaker received therein;

an ear hanger connected to said main body, said ear hanger being adapted to be mounted on said ear, said ear hanger having a curved shape, wherein:

said ear hanger comprises a core and a sheathing member for surrounding at least part of said core so as to provide a dual structure, said core being formed of hard material and said sheathing member being formed of elastic material.

According to the features of the first aspect of the present invention, when the user puts on the earphone so that the loudspeaker received in the main body is placed at the entrance of the external auditory meatus of the user's ear, the ear hanger is fitted to the outer peripheral portion of the ear in a wrap-around state. The ear hanger, which has the dual structure, provides the functions of holding securely the main body by means of the core formed of the hard material, on the one hand, and of bring the soft sheathing member formed of the elastic material into contact with the user's ear, on the other hand. As a result, the core permits to maintain a stable fitting condition in use, on the one hand, and the existence of the sheathing member permits to prevent an unpleasant feeling of the user in his/her ear.

In the second aspect of the present invention, there may be adopted a structure in which said at least part of said core has a rectangular cross section having a long side and a short side, said short side being directed to said main body. According to such features of the second aspect of the present invention, such an arrangement of the core permits the core to be deformed easily and resiliently in the direction of the short side of the rectangular cross section thereof, i.e., along the plane extending in the short side direction of the rectangular cross section so that the position of the ear hanger relative to the main body can easily be adjusted in accordance with the shape of the user's ear, on the one hand, and prevents the core from being deformed easily in the direction of the long side of the rectangular cross section thereof, i.e., along the other plane extending in the long side direction of the rectangular cross section so that the position of the ear hanger can be maintained appropriately without loosing on the other plane as mentioned above. It is therefore possible to give a user a comfortable feeling in use of the earphone.

In the third aspect of the present invention, said hard material may have a spring property. According to such a feature of the third aspect of the present invention, the fitting property of the ear hanger can remarkably be improved. In the fourth aspect of the present invention, such hard material may be one of resin material and metallic material.

In the fifth aspect of the present invention, said elastic material may be one of thermoplastic elastomer and rubber, which is thermally formable under pressure. According to such a feature of the fifth aspect of the present invention, the sheathing member provides a more comfortable feeling in use of the earphone. Formability of the sheathing member can also be improved.

DETAILED DESCRIPTION OF THE PREFERRED EMBODIMENTS

Now, an embodiment of an earphone of the present invention will be described in detail below with reference to the accompanying drawings.

Figure 1:
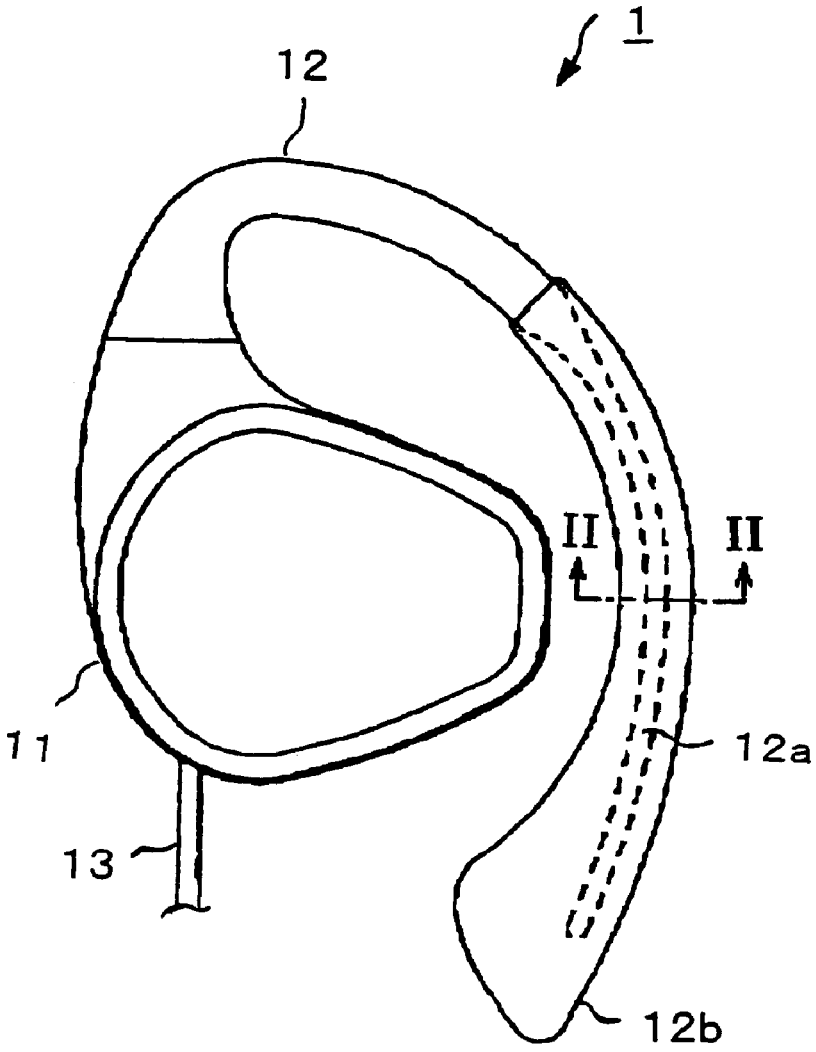
FIG. 1 is a front view illustrating an earphone of an embodiment of the present invention.

Description will be given below of the structure of the earphone of the present invention with reference to FIGS. 1 and 2. FIG. 1 is a front view illustrating the earphone 1 so as to show the opposite side thereof to a reference plane, which is to come into contact with an ear of a user. The earphone 1 will be described below as being exclusively used for the left-hand ear of the user. As shown in FIG. 1, the earphone 1 of the embodiment of the present invention is composed of a main body 11, an ear hanger 12 and a connection cord 13. The main body 11 receives a speaker unit (not shown), i.e., a loudspeaker therein. The ear hanger 12 is pivotably connected to one side of the main body 11 so as to extend in the form of arm. The connection cord 13, which is electrically connected to the speaker unit, extends from the main body 11.

The main body 11 is formed for example of synthetic resin so as to receive the speaker unit therein. The main body 11 generally has a prescribed thickness and a rounded shape so as to suitably fit to an ear of a user. When the user puts on the earphone, the central portion of the speaker unit substantially aligns with the center of the entrance of an external auditory meatus of the ear. The ear hanger 12 is pivotably connected to the main body 11 so as to be swingable relative to the main body 11. The connection cord 13, which supplies an electric signal to the speaker unit, extends from the lower portion of the main body 11. The external end of the connection cord 13 is connectable to a prescribed audio system having a music reproduction performance.

The ear hanger 12 has one end, which is pivotably connected to the main body 11, and the other end, which curves smoothly in the form of arm. The ear hanger 12 has such a curved shape so as to suitably fit to an ear of any user, thus providing a state in which the ear hanger 12 can be turned along the outer peripheral portions of the ear so as to be mounted thereon. The ear hanger 12 has the above-described pivotal structure, which permits the ear hanger 12 to swing toward a viewer of FIG. 1. The pivotal structure permits to adjust the distance between the main body 11 and the ear hanger 12 when a user puts on the earphone 1.

The ear hanger 12 is composed of a core 12*a*, which extends from the main body 11 and a sheathing member 12*b*, which surrounds the front side portion of the core 12, so as to provide a dual structure, as shown in FIG. 1. The core 12*a* is formed of hard material such as hard synthetic resin or metallic material. The sheathing member 12*b* is formed of elastic material such as soft rubber. The ear hanger 12, which is composed of the materials having different characteristics from each other, i.e., the core 12*a* formed of the hard material and the sheathing member 12*b* formed of the elastic material, therefore permits to provide a stable fitting condition in use of the earphone and to prevent an unpleasant feeling of a user in his/her ear, even when the ear hanger 12 comes into contact with the user's ear for a long period of time.

Figure 2:
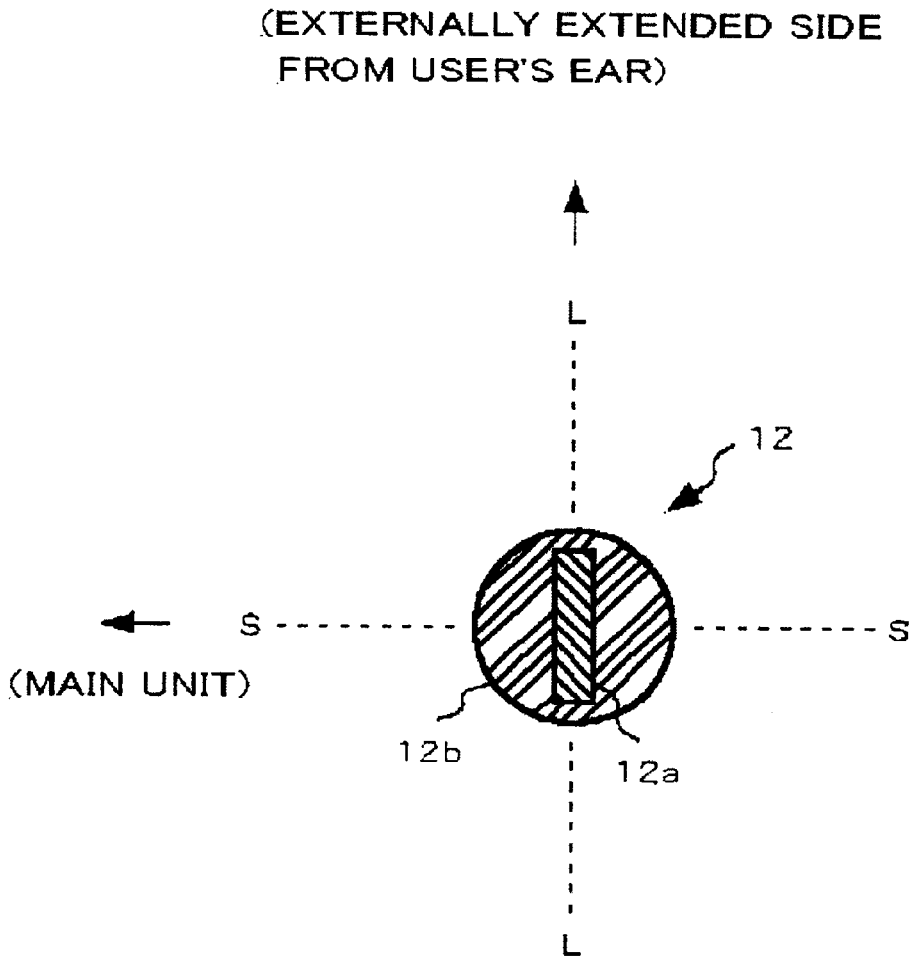
FIG. 2 is a cross-sectional view cut along the line II—II in FIG. 1.

FIG. 2 shows the cross section of the ear hanger 12, cut along the line II—II in FIG. 1. As shown in FIG. 2, the ear hanger 12 has the cross-sectional structure in which the sheathing member 12*b* has a circular cross section, on the one hand, and the core 12*a* has a rectangular cross section, on the other hand. The rectangular cross section mentioned above has a long side and a short side. The long side direction "L" of the rectangular cross section is directed to a side externally extended from the user's ear. The short side direction "S" of the rectangular cross section is directed to the main body 11. Such a cross-sectional structure of the ear hanger 12 is provided in order to improve the fitting property of the earphone 1 to the ear. Effects of such a structure will be described in detail later.

The cross-sectional shape of the core 12*a* of the present invention is not limited only to the above-mentioned rectangle as shown in FIG. 2. The core 12*a* may have a cross section such as the other polygonal shape. The cross-sectional shape of the sheathing member 12*b* is not limited only to the above-mentioned circle as shown in FIG. 2. The sheathing member 12*b* may have the other cross section, and especially have a complicated cross-section, taking into consideration a design of the earphone 1.

Figure 3:
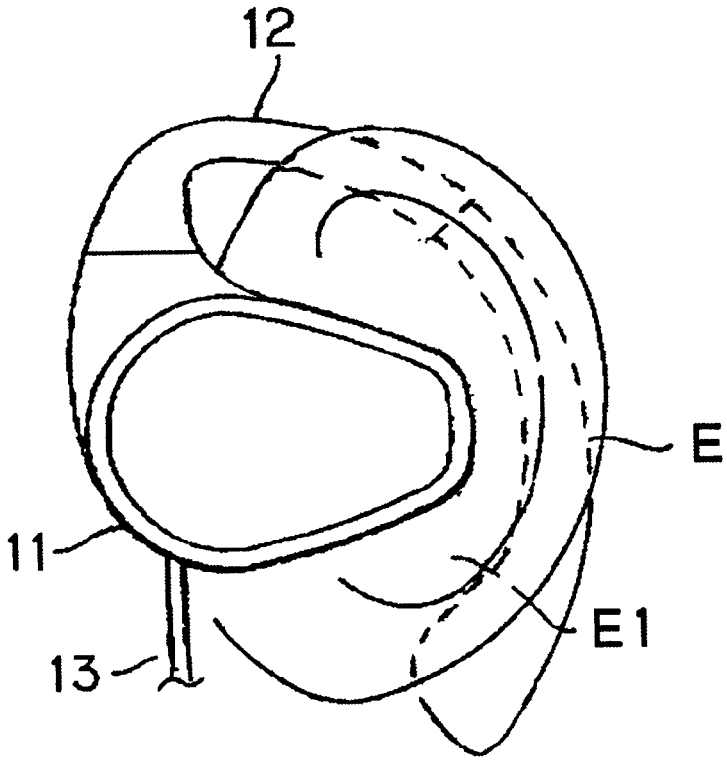
FIG. 3 is a descriptive view illustrating a state in which the earphone of the present invention is fitted to a user's ear.

Now, the fitting state of the earphone 1 on the user's ear will be described below with reference to FIG. 3. FIG. 3 is a view illustrating a state in which the earphone 1 is mounted on the left-hand ear "E" of a user. When the earphone as shown in FIG. 1 is mounted on the left-hand ear as shown in FIG. 3, the main body 11 is placed in a recess E1 of the ear "E" and the central portion of the speaker unit substantially aligns with the center of the entrance of an external auditory meatus of the ear "E".

The ear hanger 12 is turned along the outer peripheral portion of the ear "E" to be mounted thereon in a wrap-around state. The ear hanger 12 has the curved shape, which is appropriately fitted to the shape of the outer peripheral portion of the left-hand ear "E", thus providing a stable fitting condition. In such state, the ear hanger 12 can easily be deformed resiliently in the short side direction of the rectangular cross section of the core 12*a* relative to the left-hand ear "E". The above-mentioned short side direction corresponds to a direction parallel to the drawing surface of FIG. 3. It is therefore possible to adjust the positional relationship of the ear hanger 12 relative to the main body 11 in accordance with the shape of the user's ear, thus giving a user a comfortable feeling in use of the earphone 1. On the contrary, the core 12*a* cannot easily be deformed in the long side direction "L" of the rectangular cross section of the core 12*a*. The above-mentioned long side direction corresponds to a direction perpendicular to the drawing surface of FIG. 3. It is therefore possible to maintain an appropriate position of the ear hanger 12 relative to the left-hand ear "E" without loosing, thus also giving the user the comfortable feeling in use of the earphone 1.

The earphone 1 is mounted on the left-hand ear "E" so that the left-hand ear "E" is held from its inner and outer sides between the main body 11 and the ear hanger 12. The earphone 1 can securely be mounted on the left-hand ear "E", without causing an improper displacement. The sheathing member 12, which is provided at the front side portion of the ear hanger "E", comes into contact with the left-hand ear "E". More specifically, the core 12*a* does not come into direct contact with the user's left-hand ear "E", and only the sheathing member 12 comes into direct contact with the ear "E" in order to mount the earphone 1 thereon. Bringing an ear hanger formed of hard material into direct contact with the user's ear for a long period of time may cause damage to the soft skin surface on the outer peripheral portion of the ear. On the contrary, forming the portion of the earphone 1, which is to be brought into contact with the left-hand ear "E", of the resilient material in the present invention makes it possible to prevent the damage to the user's ear "E", thus continuing the fitting state of the earphone 1 with a comfortable feeling in use.

Now, description will be given below in detail of the materials for the core 12*a* of the ear hanger 12 and the sheathing member 12*b*. With respect to the material for the core 12*a*, there may be used resin material or metallic material having a spring property so as to provide a suitable supporting force when mounting the earphone 1 on the ear. More specifically, in case where the core 12*a* is formed of synthetic resin, ABS resin or acetol resin may be used. In case where the core 12*a* is formed of metallic material, spring copper or superelastic alloy may be used.

With respect to the material for the sheathing member 12*b*, there may be used the soft elastic material having a function of preventing damage to the user's ear. More specifically, the sheathing member 12*b* may be formed of thermoplastic elastomer or rubber such as NBR or SBR, which is thermally formable under pressure. Any one of the above-mentioned materials is suitably applicable to the manufacture of the ear hanger 12 through a thermal forming process under pressure, as described below.

A method for manufacturing the ear hanger 12 will be described briefly. Manufacture of the earphone of the above-mentioned embodiment in which the ear hanger 12 has the dual structure requires an appropriate manufacturing process. In case where the sheathing member 12*b* is formed of the thermoplastic elastomer, there may be carried out the steps of preparing the above-described core 12*a*, and forming the sheathing member 12*b* so as to surround the core 12*a* through an injection molding. In case where the sheathing member 12*b* is formed of the above-mentioned rubber, there may be carried out the steps of preparing the above-described core 12*a*, and forming the sheathing member 12*b* so as to surround the core 12*a* through the thermal forming process under pressure. The ear hanger 12 may be formed by carrying out the steps of preparing the above-described core 12*a*, forming the sheathing member 12*b* separately from the core 12*a* and inserting the core 12*a* into the thus formed sheathing member 12*b*. In case where material such as ABS or acetol resin, which is injection-moldable, is used for forming the core 12*a*, on the one hand, and material such as thermoplastic elastomer, which is also injection-moldable, is used for forming the sheathing member 12*b*, a simultaneous molding utilizing a single mold may be applied to manufacture the ear hanger 12.

Figure 4:
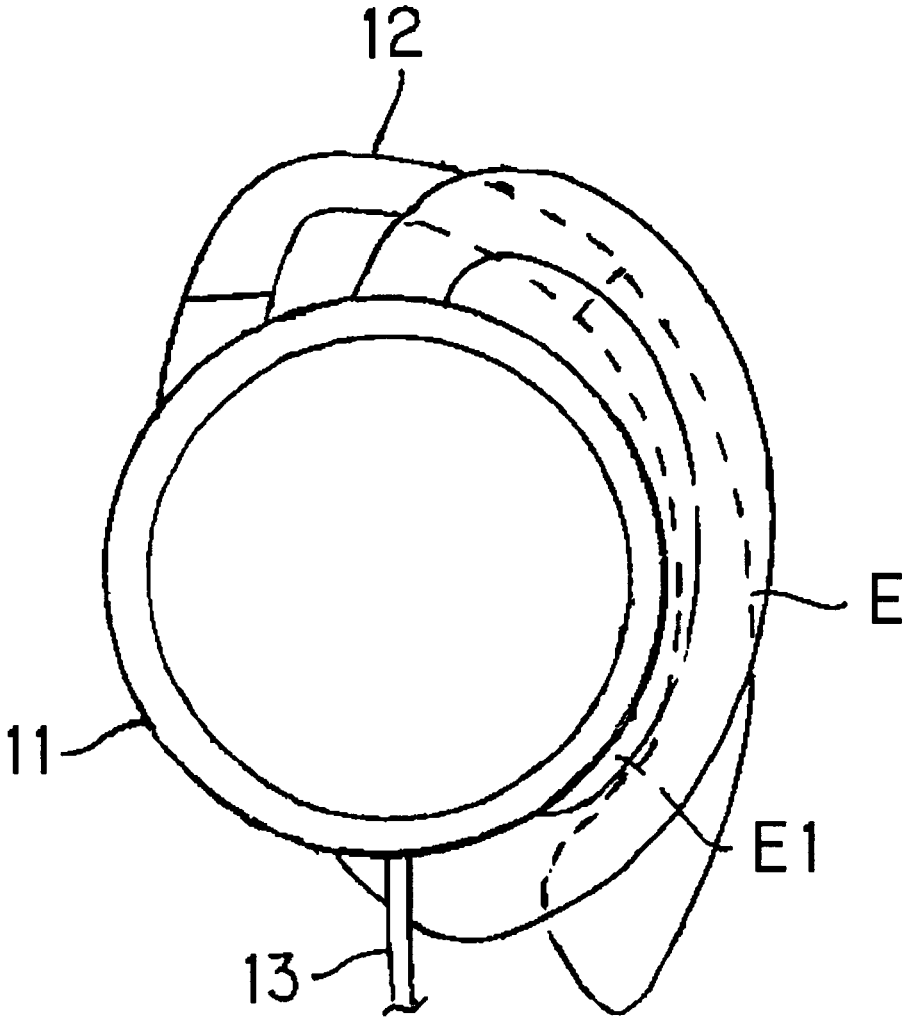
FIG. 4 is a view illustrating a modification of the earphone of the present invention.

FIG. 4 shows a modification of the earphone 1 of the embodiment of the present invention. In the above-described embodiment of the present invention, the present invention is applied to the earphone 1 in which the main body 11 is placed in the recess E1 of the ear "E" in use. The earphone as shown in FIG. 4 has a main body 11, which is to be laid on the ear in use. In the modification as shown in FIG. 4, the earphone, which is mounted on the left-hand ear "E", is composed of a main body 11, an ear hanger 12 and a connection cord 13 in the same manner as FIG. 3. The ear hanger 12 and the connection cord 13 of the modification are substantially identical to those of the above-described embodiment. The main body 11 of the modification differs from the main body 11 of the above-described embodiment in that the former has a circular shape so that the entirety of the main body 11 is laid on the ear in use. In the modification of the earphone, the ear hanger 12 can provide the same technical effects as described above.

The shape and the material for the ear hanger 12 are not limited only to those as described above. The earphone 1 of the present invention may be modified, taking into consideration the technical effects as described above.

According to the present invention as described in detail, the ear hanger of the earphone has the dual structure in which the sheathing member formed of elastic material surrounds the core formed of hard material. It is therefore possible to provide the earphone, which permits to maintain a stable fitting condition in use and prevent an unpleasant feeling of a user in his/her ear, even in case where the earphone is used for a long period of time.

The entire disclosure of Japanese Patent Application No. 2001-264021 filed on Aug. 31, 2001 including the specification, claims, drawings and summary is incorporated herein by reference in its entirety.

What is claimed is:

1. An earphone comprising:

a main body to be placed at an entrance of an external auditory meatus of an ear of a user, said main body including a loudspeaker received therein;

an ear hanger connected to said main body, said ear hanger being adapted to be mounted on said ear, said ear hanger having a curved shape, wherein:

said ear hanger comprises a core and a sheathing member for surrounding at least part of said core so as to provide a dual structure, said core being formed of hard material having a spring property and said sheathing member being formed of elastic material, said ear hanger having a first elastic deformability in an expanding direction of said curved shape on a reference plane and a second elastic deformability in a perpendicular direction to said reference plane, said first elastic deformability being larger than said second elastic deformability.

2. The earphone as claimed in claim 1, wherein:

said at least part of said core has a rectangular cross section having a long side and a short side, said short side being directed to said main body.

3. The earphone as claimed in claim 1, wherein:

said hard material is one of resin material and metallic material.

4. The earphone as claimed in claim 2, wherein:

said hard material is one of resin material and metallic material.

5. The earphone as claimed in claim 1, wherein:

said elastic material is one of thermoplastic elastomer and rubber, which is thermally formable under pressure.

6. The earphone as claimed in claim 2, wherein:

said elastic material is one of thermoplastic elastomer and rubber, which is thermally formable under pressure.

* * * * *